US010876403B2

(12) United States Patent
Miao

(10) Patent No.: US 10,876,403 B2
(45) Date of Patent: Dec. 29, 2020

(54) METHOD FOR MINING ULTRA-THICK COAL SEAM BY UTILIZING GOAF SOLID BACKFILLING TECHNIQUE

(71) Applicant: Xiexing Miao, Xuzhou (CN)

(72) Inventor: Xiexing Miao, Xuzhou (CN)

( * ) Notice: Subject to any disclaimer, the term of this patent is extended or adjusted under 35 U.S.C. 154(b) by 44 days.

(21) Appl. No.: 16/254,601

(22) Filed: Jan. 23, 2019

(65) Prior Publication Data

US 2020/0040727 A1 Feb. 6, 2020

(30) Foreign Application Priority Data

Aug. 2, 2018 (CN) ..... 2018 1 0869680

(51) Int. Cl.

| | |
|---|---|
| ***E21F 15/00*** | (2006.01) |
| ***E21F 15/04*** | (2006.01) |
| ***E21C 41/18*** | (2006.01) |

(52) U.S. Cl.

CPC ..... *E21C 41/18* (2013.01); *E21F 15/005* (2013.01); *E21F 15/04* (2013.01)

(58) Field of Classification Search

CPC ..... E21C 41/20; E21C 41/22; E21C 41/16; E21C 41/18; E21C 41/24; E21F 15/04; E21F 15/00; E21F 15/005; E21F 15/02; E21F 15/06; E21F 15/08; E21F 15/10

See application file for complete search history.

(56) References Cited

U.S. PATENT DOCUMENTS

2017/0138194 A1* 5/2017 Ju ..... E21F 15/02

FOREIGN PATENT DOCUMENTS

| | | | | |
|---|---|---|---|---|
| CN | 103726846 A | | 4/2014 | |
| CN | 104832178 A | * | 8/2015 | |
| CN | 105317438 A | * | 2/2016 | |
| CN | 106939789 A | * | 7/2017 | |
| CN | 107939401 A | * | 4/2018 | |
| DE | 3644581 A1 | * | 7/1987 | ..... E21F 15/005 |
| GB | 2177389 A | * | 1/1987 | ..... C04B 28/065 |

OTHER PUBLICATIONS

English language machine translation of Wang et al., CN-1037268846-A, published Apr. 16, 2014 (7 pages) (Year: 2014).*

English language machine translation of Zhang et al., CN-107939401-A, published Apr. 20, 2018 (4 pages) (Year: 2018).*

* cited by examiner

*Primary Examiner* — Janine M Kreck

*Assistant Examiner* — Michael A Goodwin

(74) *Attorney, Agent, or Firm* — Bayramoglu Law Offices LLC

(57) ABSTRACT

A method for mining an ultra-thick coal seam by utilizing a goaf solid backfilling technique is suitable for mining an ultra-thick coal seam having a thickness of 25 m-45 m. According to the method, the ultra-thick coal seam is sliced into three slices, i.e. an upper slice, a middle slice and a lower slice. First, the middle slice is subjected to solid backfilling and mining. Metal meshes are paved along a working face of the floor. The backfilling layer serves as an artificial floor for mining the upper slice and an artificial roof for mining the lower slice. Then, the upper slice is mined by the top coal caving mining based on the artificial floor formed by backfilling the goaf of the middle slice. Finally, the lower slice is mined by the top coal caving mining along the coal seam floor with the shield of the artificial roof.

5 Claims, 4 Drawing Sheets

METHOD FOR MINING ULTRA-THICK COAL SEAM BY UTILIZING GOAF SOLID BACKFILLING TECHNIQUE

CROSS REFERENCE TO THE RELATED APPLICATIONS

This application is based upon and claims priority to Chinese Patent Application No. CN201810869680.9, filed on Aug. 2, 2018, the entire contents of which are incorporated herein by reference.

TECHNICAL FIELD

The present invention relates to a method for mining coal seams, particularly to a method for mining an ultra-thick coal seam by utilizing a goaf solid backfilling technique, which pertains to the technical field of coal mining.

BACKGROUND

In China's coal resources, the extra-thick coal seams having a thickness more than 8 meters account for 44% of the total coal reserves, and the ultra-thick coal seams having a thickness more than 30 meters also hold a certain proportion. Especially, with the development of coal resource mining in Xinjiang and other western areas of China, the mining proportion of these types of coal seams will gradually increase. For mining the ultra-thick coal seams, a method of descending slicing mining or ascending backfilling slicing mining is generally used. The descending slicing mining method currently used has limited applications due to the problems like repeated roof cracking, intensive strata behaviors, and roof caves easily. A Chinese patent application No. 20141016894 (published as CN-103726846-A) discloses "a coal mining method for extra-thick and ultra-thick coal seams based on ascending slicing mining". According to the application, the extra-thick and ultra-thick coal seams are reasonably sliced. The lower sliced mining faces are mined and backfilled, respectively, and the backfilling effects and roof movement are analyzed. Then, the respective slices are mined step by step in an ascending manner, until the backfilling and mining of all layers is completed. Although the use of the backfilling ascending slicing mining technique can realize the mining of ultra-thick coal seams, there is a resource shortage of the backfilling materials, the yield of a large-scale mining is low, which is costly. Moreover, these two methods require many slices, frequent working face remove, and have low coal recovery rate, low efficiency, and safety control is difficult.

SUMMARY

In order to overcome the various drawbacks existing in the prior art, the present invention provides a method for mining an ultra-thick coal seam by utilizing a goaf solid backfilling technique, which can improve the safety of coal mining, reduce the costs, reduce the remove frequency, and improve the resources recovery rate.

In order to solve the above-mentioned problems, the present invention provides a method for mining an ultra-thick coal seam by utilizing a goaf solid backfilling technique, which includes the following steps:

a. slicing the ultra-thick coal seam into three mining slices from top to bottom, namely, an upper slice, a middle slice, and a lower slice;

b. first, mining the middle slice, which includes arranging a solid dense backfilling coal mining working face in the middle slice for stoping, paving metal meshes along a floor in a process of removing a hydraulic support, connecting adjacent metal meshes with an interval of a step distance by iron wires, backfilling a goaf with solids, and tamping the solids until backfilling and mining of the middle slice is completed, wherein a backfilling layer respectively serves as an artificial floor and an artificial roof in the mining of the upper slice and the lower slice;

c. next, mining the upper slice, which includes arranging a top coal caving working face for stoping, based on the artificial floor formed by backfilling the goaf in the middle slice, wherein top coals are broken and fall down as the working face moves forward, and broken coals exit from a coal caving port of a fully mechanized top coal caving hydraulic support and are delivered out from the working face by a conveyor located at a rear part of the support, and the backfilling layer is further tamped by fallen waste rocks and an overlying rock strata;

d. subsequently, mining the lower slice, which includes arranging the top coal caving working face along the floor of the coal seam for stoping, under a shield of the artificial roof formed by backfilling the middle slice, wherein top coals are broken and fall down as the working face moves forward, and broken coals exit from the coal caving port of the fully mechanized top coal caving hydraulic support and are delivered out from the working face by the conveyor located at the rear part of the support.

According to the present method, the ultra-thick coal seam is sliced into three slices from top to bottom, in which the number of slices is significantly reduced compared with the previous mining techniques, thereby simplifying the process and effectively reducing the frequency of removing and changing working face. Regarding the mining sequence, the middle slice is mined at first, and the goaf is backfilled with solid materials in the process of transferring the support. The backfilled middle slice can replace the retained coal seam to serve as a false roof, so as to provide a reliable floor for mining the upper slice and provide a reliable roof for mining the lower slice. Under the shield of the solid backfilled in the middle slice, the backfilling and mining of the lower slice is performed, so that the pressure on the working face is uniformly distributed, and the coal caving is efficient. Also, the production is safer since the fluid in the upper goaf is effectively isolated.

Further, coal ash, clay, or a mixture of these cohesive materials is added into a solid backfilling material of the middle slice to account for more than 30% of the solid backfilling material. The combination of the metal mesh and the cohesive material makes the backfilling layer of the middle slice more integral and flexible, and the backfilling layer can provide a stable and reliable floor and roof for the mining of the upper slice and the lower slice.

Preferably, the method can stope an ultra-thick coal seam resource having a thickness of 25 m-45 m.

Further, in step a, the slices are reasonably sliced according to an analysis of a coal seam thickness, a coal hardness, roof and floor conditions, and technical parameters of a mining equipment of the ultra-thick coal seam.

Preferably, for the top coal caving working face of the upper slice, a coal mining height ranges from 3 m to 5 m and a coal caving height ranges from 7 m to 15 m; for the solid dense backfilling coal mining working face of the middle slice, a coal mining height ranges from 2 m to 3 m; and for the top coal caving working face of the lower slice, a coal mining height ranges from 3 m to 7 m, and a coal caving height ranges from 10 m to 15 m.

The present invention has the following advantages. (1) According to the geological conditions for mining the coal seam, the coal seam is reasonably divided into three slices, which reduces the number of times for mining respective slices, simplifies the process, saves the cost, and improves the mining safety and efficiency. (2) The middle slice is densely backfilled with solid materials to replace the retained coals and serve as a false roof. Further, base meshes are arranged on the backfilling layer and cohesive materials are added into the backfilling layer to make the backfilling layer integral and flexible. Accordingly, the backfilling layer can serve as stable and reliable roof and floor for mining upper and lower slices, thereby reducing the risk of spontaneous combustion of coals on the working face, improving the mining efficiency of the upper and lower slices, and scientifically disposes the solid waste in the mining area. (3) Based on a primary mining of the middle slice, the upper slice is subjected to a top coal caving mining, so the top coal are broken evenly, the coal caving is more efficient, stope strata pressure is easy to control, and the mining is safer. (4) Under the shield of the artificial integral flexible roof backfilled in the middle slice, the backfilling and the mining of the lower slice are performed, so the pressure on the working face is uniformly distributed, the coal caving is efficient, and the production is safer after the fluid in the upper goaf is effectively isolated. Therefore, the method of the present invention can realize the mining of the ultra-thick coal seam in safe, high-efficiency, and high recovery rate.

In the figures,

1: coal seam roof, 2: upper slice, 3: middle slice, 4: lower slice, 5: coal seam floor, 6: backfilling fully-mechanized top coal caving hydraulic support, 7: bottom unloading conveyor, 8: tamping machine, 9: metal mesh, 10: solid backfilling material, 11: fully-mechanized top coal caving hydraulic support, 12: coal caving port, 13: scraper conveyor, and 14: overlying rock strata.

DETAILED DESCRIPTION OF THE EMBODIMENTS

The present invention will be described in detail hereinafter with reference to the drawings.

A method for mining an ultra-thick coal seam by utilizing a goaf solid backfilling technique includes the following steps.

Figure 1:
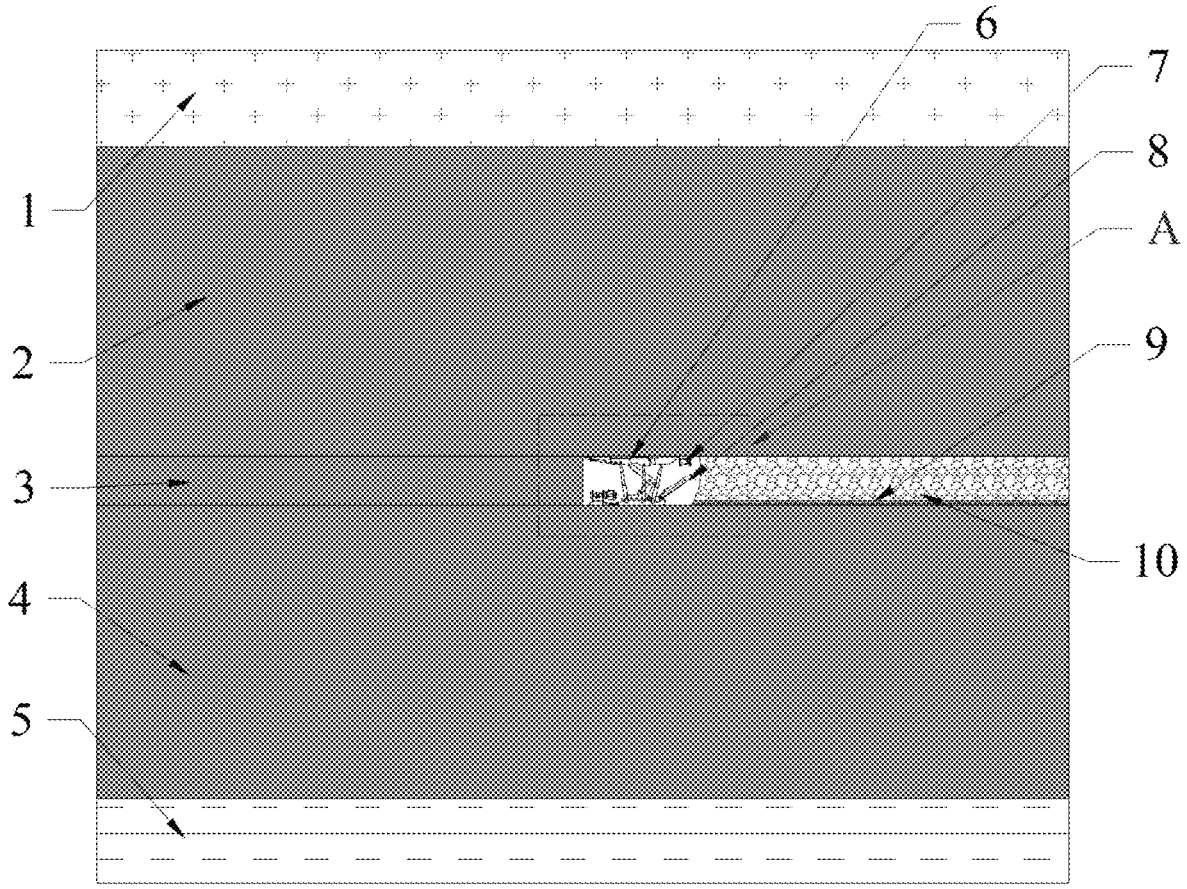
FIG. 1 is a cross-sectional schematic diagram showing the backfilling and mining in the middle slice of the coal seam of the present invention.
Figure 2:
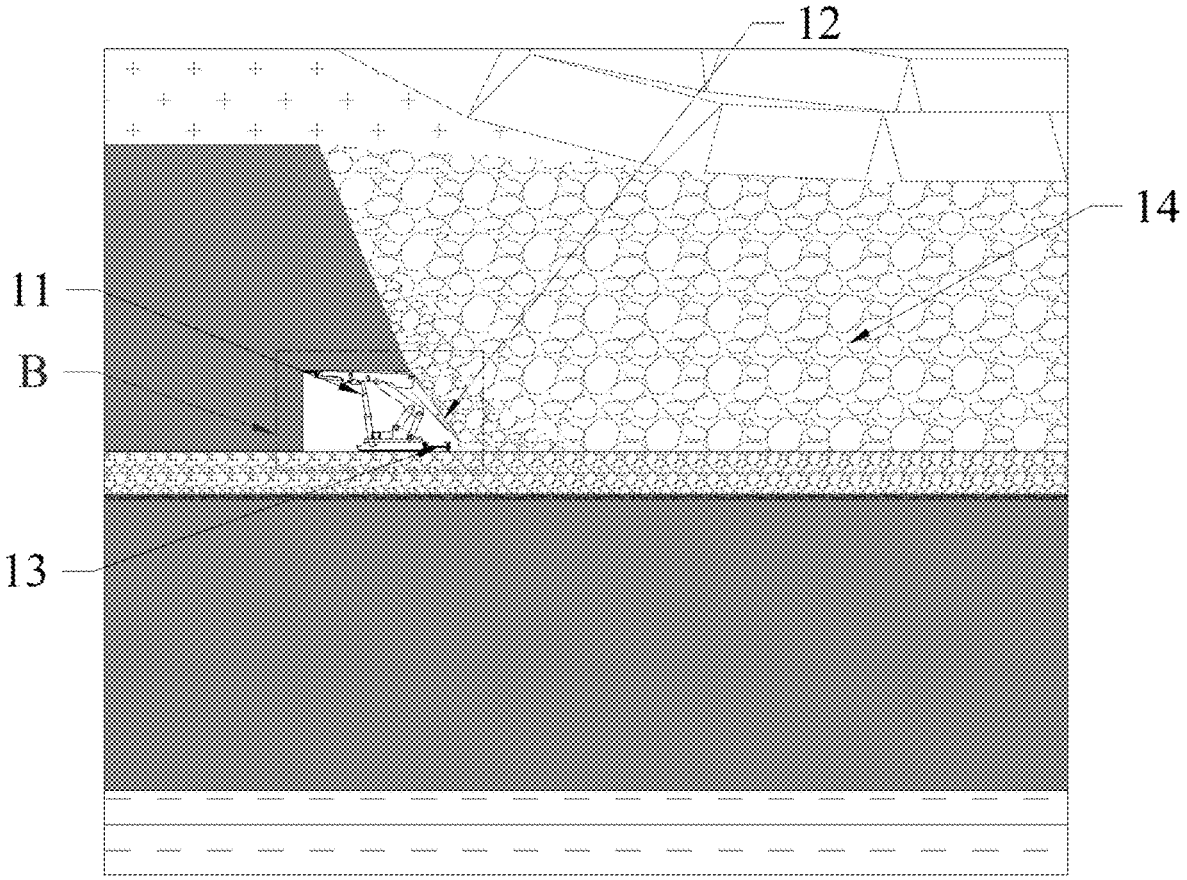
FIG. 2 is a cross-sectional schematic diagram showing the top coal caving mining in the upper slice of the coal seam of the present invention.
Figure 3:
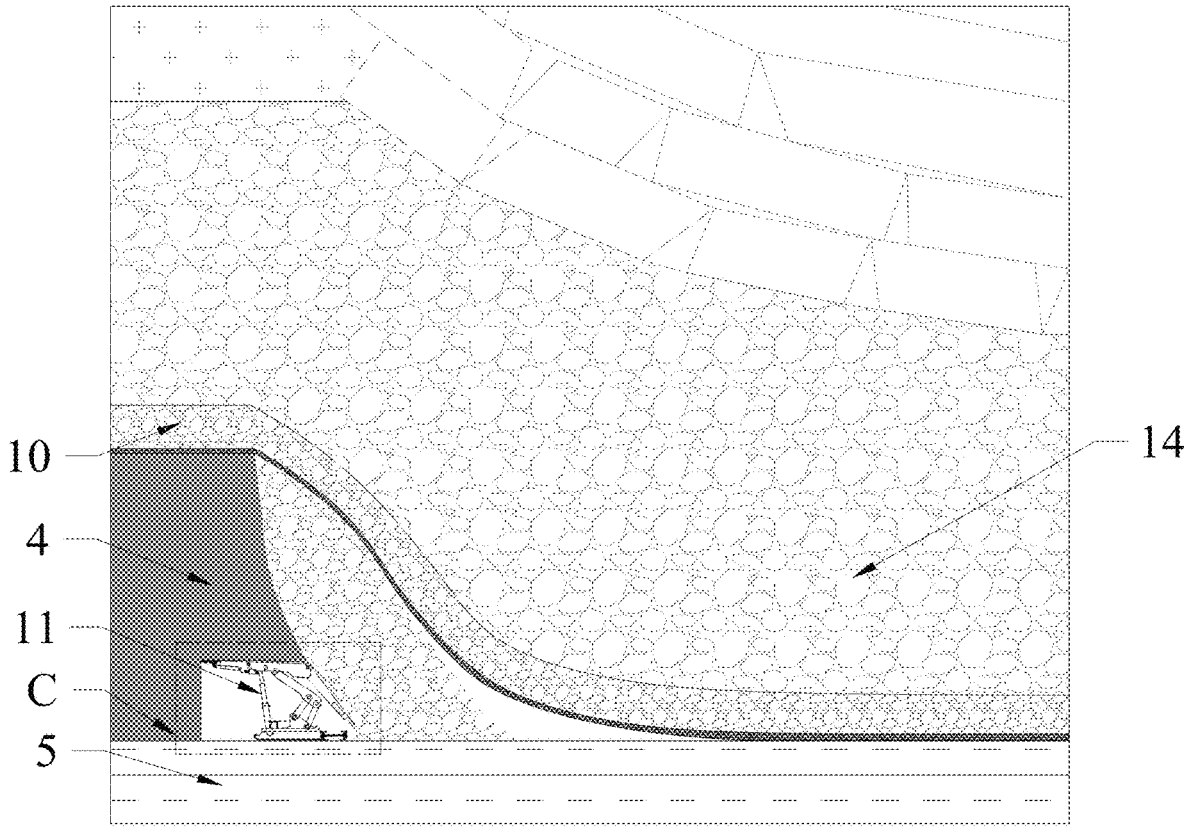
FIG. 3 is a cross-sectional schematic diagram showing the top coal caving mining in the lower slice of the coal seam of the present invention.

As shown in FIGS. 1-3, step a includes: slicing the ultra-thick coal seam into three mining slices from top to bottom, namely, an upper slice 2, a middle slice 3 and a lower slice 4. The slices are reasonably sliced according to an analysis of a coal seam thickness, a coal hardness, roof and floor conditions, and technical parameters of a mining equipment of the ultra-thick coal seam.

The upper slice is a fully-mechanized top coal caving working face, the middle slice is a solid backfilling working face, and the lower slice is a fully-mechanized top coal caving working face.

Figure 4:
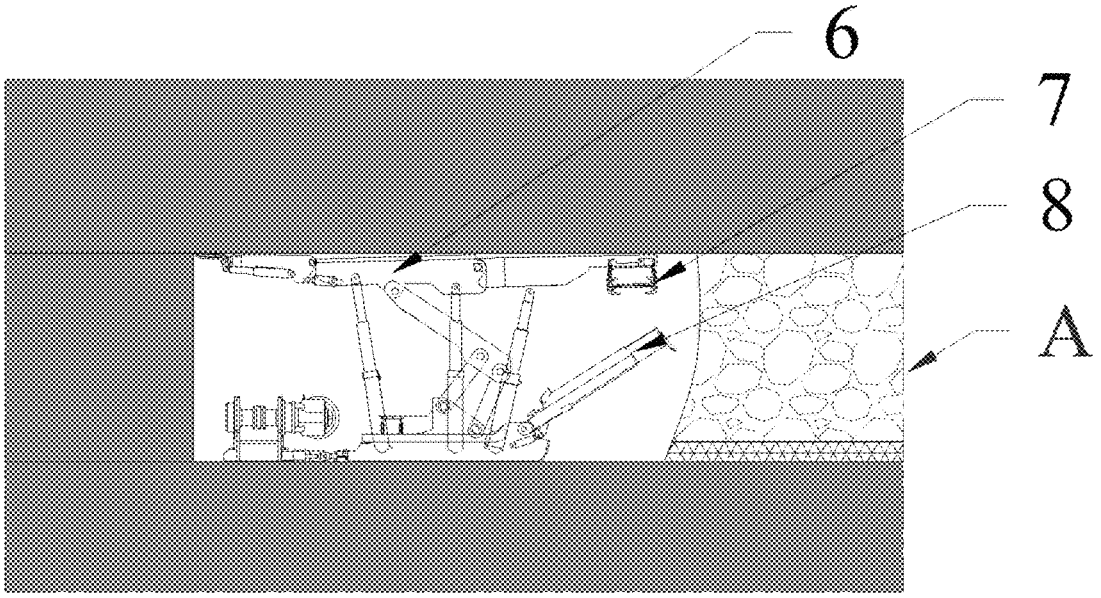
FIG. 4 is an enlarged view of a portion A in FIG. 1.

Preferably, the method of the present invention can stope an ultra-thick coal seam resource having a thickness of 25 m-45 m. For the top coal caving working face 2 of the upper slice, a coal mining height ranges from 3 m to 5 m and a coal caving height ranges from 7 m to 15 m. For the solid dense backfilling coal mining working face 3, a coal mining height ranges from 2 m to 3 m. For the top coal caving working face 4 of the lower slice, a coal mining height ranges from 3 m to 7 m, and a coal caving height ranges from 10 m to 15 m. As shown in FIG. 1 and FIG. 4, the step b includes: mining the middle slice 3 first. A solid dense backfilling coal mining working face is arranged in the middle slice 3 for stoping. Metal meshes 9 are paved along a floor in a process of removing a hydraulic support 6. Adjacent metal meshes with an interval of a step distance are connected by iron wires. A goaf is backfilled with solids, and the solids are tamped until a backfilling and a mining of the middle slice are completed. A backfilling layer respectively serves as an artificial floor and an artificial roof in the mining of the upper slice and the lower slice. Coal ash, clay, or a mixture of these cohesive materials is added into a solid backfilling material 10 of the middle slice to account for more than 30% of the solid backfilling material. The combination of the metal mesh 9 and the cohesive material makes the backfilling layer of the middle slice more integral and flexible, and the backfilling layer can serve as an artificial floor for the mining of the upper slice and an artificial roof for the mining of the lower slice.

Figure 5:
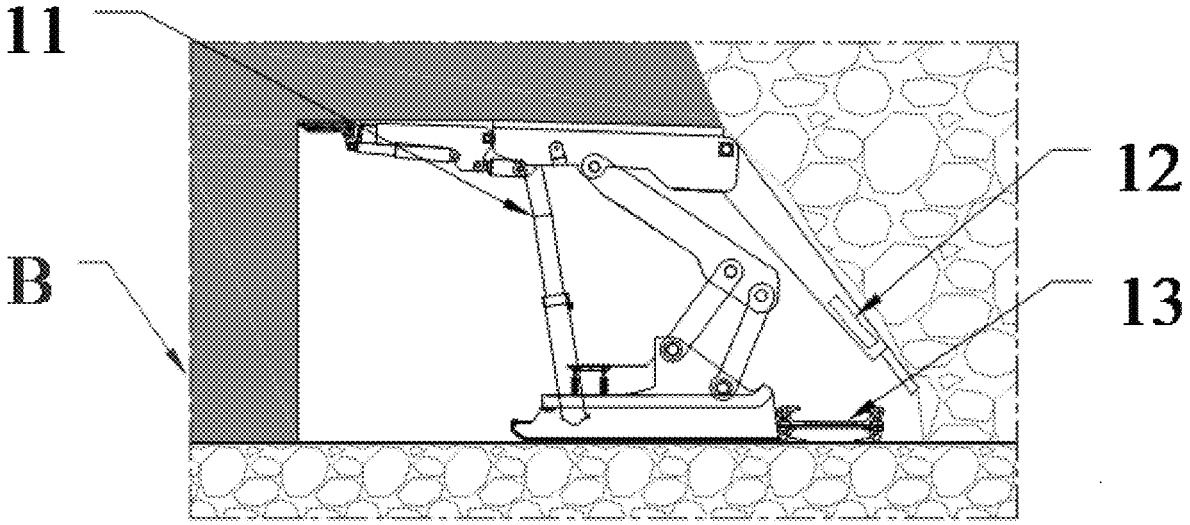
FIG. 5 is an enlarged view of a portion B in FIG. 2.

As shown in FIG. 2 and FIG. 5, the step c includes: mining the upper slice 2, subsequently. A top coal caving working face is arranged for stoping, based on the artificial floor formed by backfilling the goaf in the middle slice 3. The top coals are broken and fall down as the working face moves forward, and the broken coals exit from a coal caving port 12 of a fully mechanized top coal caving hydraulic support 11. The shielding support of the fully mechanized top coal caving hydraulic support 11 supports against the fallen waste rocks of the overlying strata in an inclined manner. The fallen top coals are delivered out from the working face by the scraper conveyor 13 arranged above the solid backfilling layer. The backfilling layer is further tamped by the overlying rock strata 14 formed by fallen waste rocks.

Figure 6:
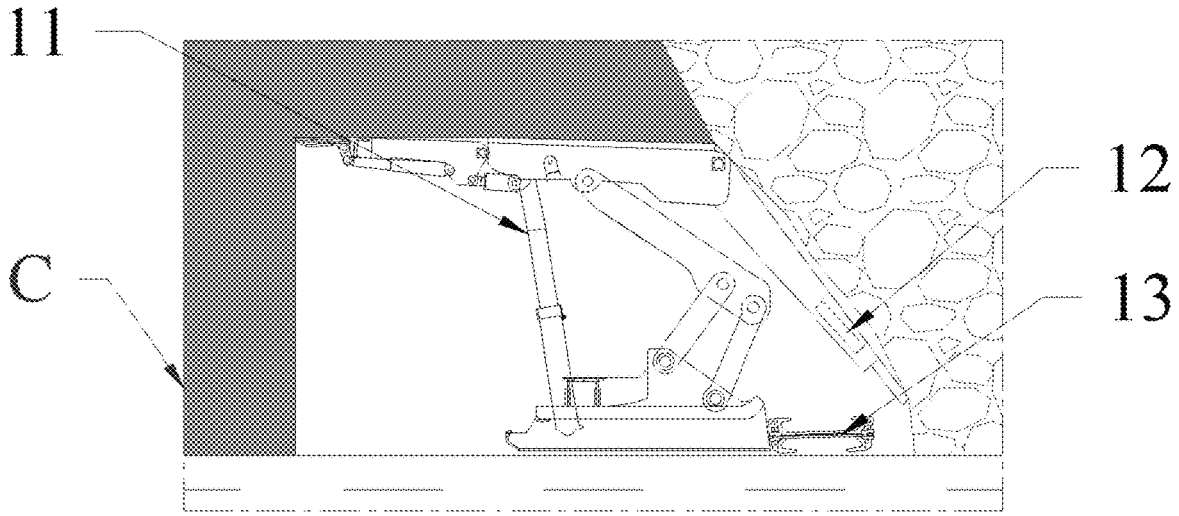
FIG. 6 is an enlarged view of a portion C in FIG. 3.

As shown in FIG. 3 and FIG. 6, the step d includes: mining the lower slice, subsequently. The top coal caving working face is arranged along the floor of the coal seam for stoping, under a shield of the artificial roof formed by backfilling the middle slice. The top coals broke and fall down as the working face moves forward, and the broken coals exit from the coal caving port 12 of the fully mechanized top coal caving hydraulic support 11. The shielding support of the fully mechanized top coal caving hydraulic support 11 supports against the fallen waste rocks of the overlying strata in an inclined manner. The fallen top coals are delivered out from the working face by the scraper conveyor 13 arranged above the coal seam floor 5. Because the solid backfilling layer of the middle slice has certain extent of tenacity, when the waste rock in the lower slice falls down, the solid backfilling layer of the middle slice will form an arc-shaped curved slice instead of directly falling down and creating a great impact on the fully-mechanized top coal caving hydraulic support of the lower slice. The waste rock layer of the upper slice and the waste rock layer of the lower slice are separated, so not only the mining safety factor of the coal seam of the lower slice is greatly improved, but also the backfilling and mining in the lower slice is performed with the shield of the backfilling solid of the middle slice. Therefore, the pressure on the working face is evenly distributed, and the coal caving is more efficient.

What is claimed is:

1. A method for mining an ultra-thick coal seam by utilizing a goaf solid backfilling technique, comprising:

a. slicing the ultra-thick coal seam into three mining slices from top to bottom, wherein the three slices are an upper slice, a middle slice, and a lower slice respectively;

b. first, mining the middle slice, wherein mining the middle slice comprises: arranging a solid dense backfilling coal mining working face in the middle slice for stoping, paving metal meshes along a floor in a process of moving a hydraulic support through a step distance, connecting adjacent metal meshes by iron wires at an interval corresponding to the step distance, backfilling a goaf with solids, and tamping the solids until a backfilling and a mining of the middle slice are completed to form a backfilling layer, wherein the backfilling layer serves as an artificial floor of the upper slice and an artificial roof of the lower slice in the mining;

c. next, mining the upper slice, wherein mining the upper slice comprises: arranging a top coal caving working face of the upper slice for stoping, based on the artificial floor formed by backfilling the goaf in the middle slice, wherein top coals break and fall down as the top coal caving working face of the upper slice moves forward, and the top coals exit from a coal caving port of a fully mechanized top coal caving hydraulic support and are delivered out from the top coal caving working face of the upper slice by a conveyor located at a rear part of the fully mechanized top coal caving hydraulic support, and the backfilling layer is further tamped by fallen waste rocks and an overlying rock strata;

d. subsequently, mining the lower slice, wherein mining the lower slice comprises: arranging a top coal caving working face of the lower slice along a floor of the ultra-thick coal seam for stoping, under a shield of the artificial roof formed by backfilling the goaf in the middle slice, wherein top coals break and fall down as the top coal caving working face of the lower slice moves forward, and the top coals exit from the coal caving port of the fully mechanized top coal caving hydraulic support and are delivered out from the top coal caving working face of the lower slice by the conveyor located at the rear part of the fully mechanized top coal caving hydraulic support, wherein clay is added into a solid backfilling material of the middle slice.

2. The method for mining the ultra-thick coal seam by utilizing the goaf solid backfilling technique according to claim 1, wherein coal ash or a mixture of cohesive materials is added into the solid backfilling material of the middle slice to account for more than 30% of the solid backfilling material.

3. The method for mining the ultra-thick coal seam by utilizing the goaf solid backfilling technique according to claim 1, wherein the ultra-thick coal seam has a thickness of 25 m-45 m.

4. The method for mining the ultra-thick coal seam by utilizing the goaf solid backfilling technique according to claim 1, wherein in step a, the upper slice, the middle slice and the lower slice are sliced according to an analysis of a coal seam thickness, a coal hardness, roof and floor conditions, and technical parameters of a mining equipment of the ultra-thick coal seam.

5. The method for mining the ultra-thick coal seam by utilizing the goaf solid backfilling technique according to claim 4, wherein for the top coal caving working face of the upper slice, a coal mining height of the upper slice ranges from 3 m to 5 m and a coal caving height of the upper slice ranges from 7 m to 15 m; for the solid dense backfilling coal mining working face of the middle slice, a coal mining height of the middle slice ranges from 2 m to 3 m; and for the top coal caving working face of the lower slice, a coal mining height of the lower slice ranges from 3 m to 7 m, and a coal caving height of the lower slice ranges from 10 m to 15 m.

* * * * *